US007382319B2

(12) United States Patent
Kawahata et al.

(10) Patent No.: US 7,382,319 B2
(45) Date of Patent: Jun. 3, 2008

(54) ANTENNA STRUCTURE AND COMMUNICATION APPARATUS INCLUDING THE SAME

(75) Inventors: Kazunari Kawahata, Machida (JP); Junichi Kurita, Fleet (GB)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/581,803

(22) PCT Filed: Nov. 30, 2004

(86) PCT No.: PCT/JP2004/017788

§ 371 (c)(1),
(2), (4) Date: Jan. 8, 2007

(87) PCT Pub. No.: WO2005/055364

PCT Pub. Date: Jun. 16, 2005

(65) Prior Publication Data

US 2007/0115177 A1 May 24, 2007

(30) Foreign Application Priority Data

Dec. 2, 2003 (JP) ..... 2003-402544

(51) Int. Cl.
*H01Q 1/38* (2006.01)
*H01Q 1/24* (2006.01)
*H01Q 13/10* (2006.01)

(52) U.S. Cl. ..... 343/700 MS; 343/702; 343/770

(58) Field of Classification Search ..... 343/700 MS, 343/702, 767, 770, 846, 893
See application file for complete search history.

(56) References Cited

U.S. PATENT DOCUMENTS 6,657,593 B2 * 12/2003 Nagumo et al. ..... 343/700 MS
6,950,072 B2 * 9/2005 Miyata et al. ..... 342/702

FOREIGN PATENT DOCUMENTS

| | | |
|---|---|---|
| JP | 2-812 | 1/1990 |
| JP | 10-93332 | 4/1998 |
| JP | 2001-217643 | 8/2001 |
| JP | 2002-314330 | 10/2002 |
| JP | 2003-8326 | 1/2003 |

(Continued)

*Primary Examiner*—Shih-Chao Chen
(74) *Attorney, Agent, or Firm*—Ostrolenk, Faber, Gerb & Soffen, LLP

(57) ABSTRACT

In an antenna structure including a feeding radiation electrode and a non-feeding radiation electrode that are electromagnetically coupled to each other, due to formation of a main slit, the feeding radiation electrode includes a U-turn portion in the middle of a path circumventing the main slit from a feeding end to an open end. A sub-slit for forming an open stub that is connected to the U-turn portion and that provides the U-turn portion with electrostatic capacitance is formed in the feeding radiation electrode. By changing a value of the electrostatic capacitance to be provided by the open stub to the U-turn portion of the feeding radiation electrode, variable control of a higher-order resonant frequency F2 of the feeding radiation electrode 2 can be achieved while suppressing fluctuations in a resonant state (for example, a fundamental resonant frequency F1 and a Q-value) of a fundamental resonant frequency band of the feeding radiation electrode, in an electromagnetic coupling state between the feeding radiation electrode and the non-feeding radiation electrode, and in an impedance matching state.

9 Claims, 7 Drawing Sheets

FOREIGN PATENT DOCUMENTS

| | | |
|---|---|---|
| JP | 2003-78321 | 3/2003 |
| JP | 2004-535722 | 11/2004 |
| JP | 2005-79970 | 3/2005 |
| WO | WO 99/03168 | 1/1999 |
| WO | WO 01/18909 | 3/2001 |
| WO | WO 02/075853 | 9/2002 |
| WO | WO 03/007429 | 1/2003 |

* cited by examiner

ANTENNA STRUCTURE AND COMMUNICATION APPARATUS INCLUDING THE SAME

CROSS REFERENCE TO RELATED APPLICATION

The present application is a 35 U.S.C. §371 national phase conversion of PCT/JP2004/017788 filed Nov. 30, 2004, which claims priority of Japanese application no. JP2003-402544 filed Dec. 2, 2003, which are incorporated herein in their entirety.

BACKGROUND OF THE INVENTION

1. Technical Field

The present invention relates to an antenna structure capable of performing radio communication in a plurality of different frequency bands and to a communication apparatus including the antenna structure.

2. Background Art

FIG. 11*a* schematically shows an example of an antenna structure capable of performing radio communication in a plurality of different frequency bands. An antenna structure 1 includes a feeding radiation electrode 2 and a non-feeding radiation electrode 3. The feeding radiation electrode 2 is a λ/4 radiation electrode, and is formed by, for example, a conductor plate. A bent slit 4 including a U-shaped portion is formed in the feeding radiation electrode 2 by cutting the feeding radiation electrode 2 from an electrode edge. One side Q of the two sides of the slit at the edge of the feeding radiation electrode that are separated by the slit 4 serves as a feeding end, and the other side K serves as an open end. An electrode edge connected to the feeding end Q serves as a short-circuited portion Gq for grounding. Due to the formation of the slit 4, the feeding radiation electrode 2 has a folded shape and includes a U-turn portion T in the middle of the path from the feeding end Q toward the open end K.

The non-feeding radiation electrode 3 is also formed by a conductor plate. A bent slit 5 including a U-shaped portion is formed in the non-feeding radiation electrode 3 by cutting the non-feeding radiation electrode 3 from an electrode edge. One side Gm of the two sides at the edge of the non-feeding radiation electrode that are separated by the slit 5 serves as a short-circuited portion for grounding, and the other side 6 of the sides at the edge of the non-feeding radiation electrode serves as an open end. The non-feeding radiation electrode 3 is disposed adjacent to the feeding radiation electrode 2 with a gap therebetween such that the short-circuited portion Gm is adjacent to the short-circuited portion Gq of the feeding radiation electrode 2 with a gap therebetween.

For example, as shown by the return loss characteristics in FIG. 11*b*, a fundamental resonant frequency F1 0f a resonance that mainly operates due to the feeding radiation electrode 2 is in the vicinity of a fundamental resonant frequency f1 of a resonance that mainly operates due to the feeding radiation electrode 2 and the non-feeding radiation electrode 3 that is electromagnetically coupled to the feeding radiation electrode 2, and the frequencies F1 and f1 produce a complex or dual resonance. In addition, a higher-order resonant frequency F2 of the resonance that mainly operates due to the feeding radiation electrode 2 is in the vicinity of a higher-order resonant frequency f2 of the resonance that mainly operates due to the feeding radiation electrode 2 and the non-feeding radiation electrode 3 that is electromagnetically coupled to the feeding radiation electrode 2, and the frequencies F2 and f2 produce a complex or dual resonance.

The antenna structure 1 shown in FIG. 1 a is capable of performing radio communication in four resonant frequency bands, that is, a fundamental resonant frequency band based on the fundamental resonant frequency F1 and a higher-order resonant frequency band based on the higher-order resonant frequency F2 of the resonance that mainly operates due to the feeding radiation electrode 2 and a fundamental resonant frequency band based on the fundamental resonant frequency f1 and a higher-order resonant frequency based on the higher-order resonant frequency f2 of the resonance that mainly operates due to the feeding radiation electrode 2 and the non-feeding radiation electrode 3 that is electromagnetically coupled to the feeding radiation electrode 2.

The antenna structure 1 is installed on, for example, a circuit substrate of a radio communication apparatus. Thus, the short-circuited portions Gq and Gm of the feeding radiation electrode 2 and the non-feeding radiation electrode 3 are connected to a ground portion of the circuit substrate. In addition, the feeding end Q of the feeding radiation electrode 2 is connected to, for example, a high-frequency circuit 8 for radio communication of the radio communication apparatus.

For example, in the antenna structure 1 shown in FIG. 11*a*, when a transmission signal is supplied from the high-frequency circuit 8 of the radio communication apparatus to the feeding end Q of the feeding radiation electrode 2, the signal supply causes the feeding radiation electrode 2 to resonate. At the same time, the signal is also supplied to the non-feeding radiation electrode 3 due to electromagnetic coupling, and the non-feeding radiation electrode 3 also resonates. Thus, due to the resonance operation (antenna operation) of the feeding radiation electrode 2 and the non-feeding radiation electrode 3, a signal is radio-transmitted. In addition, when the feeding radiation electrode 2 and the non-feeding radiation electrode 3 resonate (perform an antenna operation) due to an externally arrived signal (radio wave) and receive the signal, the received signal is transmitted from the feeding end Q of the feeding radiation electrode 2 to the high-frequency circuit 8.

Patent Document 1: Japanese Unexamined Patent Application Publication No. 10-93332

In the structure shown in FIG. 11*a*, the slit 4 is formed in the feeding radiation electrode 2. Electrostatic capacitance is generated in the portion where the slit 4 is formed, and this electrostatic capacitance (C) and an inductance component (L) of the feeding radiation electrode 2 form an LC resonant circuit. The LC resonant circuit is largely involved in a resonant frequency of the feeding radiation electrode 2. Thus, variable control of the resonant frequencies F1 and F2 of the feeding radiation electrode 2 can be achieved by changing the position where the slit 4 is formed, the slit length, and the slit width in order to change a value of the electrostatic capacitance of the portion where the slit 4 is formed and a value of the inductance component of the feeding radiation electrode 2.

However, for example, when the slit length of the slit 4 is increased in order to lower the higher-order resonant frequency F2 of the feeding radiation electrode 2, the fundamental resonant frequency F1 of the feeding radiation electrode 2 is also lowered. Thus, a problem occurs in that it is not possible to lower only the higher-order resonant frequency F2 to a desired frequency. In other words, there is a problem in which it is difficult to individually control the fundamental resonant frequency F1 and the higher-order resonant frequency F2 of the feeding radiation electrode 2.

In addition, when the slit length of the slit 4 is greatly increased in order to greatly lower the higher-order resonant frequency F2 of the feeding radiation electrode 2, the slit 4 may be formed in a spiral shape (coiled shape), for example, as shown in FIG. 12. In this case, the inductance component of the feeding radiation electrode 2 becomes too large, and a signal loss in the feeding radiation electrode 2 becomes large. Thus, radio wave (electric field) radiation is suppressed. In addition, a phenomenon occurs in which electric fields emitted from portions of the feeding radiation electrode 2 cancel each other. If the slit 4 is formed in the spiral shape, the antenna gain of the antenna structure 1 (the feeding radiation electrode 2) is reduced due to the above-mentioned phenomenon.

SUMMARY OF THE INVENTION

The present invention accordingly provides an improved antenna structure that is capable of easily performing variable control of a higher-order resonant frequency of a feeding radiation electrode while hardly changing a fundamental resonant frequency of the feeding radiation electrode and avoiding reduction in an antenna gain, and a communication apparatus including such an antenna structure.

An antenna structure according to an aspect of the present invention includes a feeding radiation electrode including one end serving as a feeding end and the other end serving as an open end and performing an antenna operation in a plurality of resonant frequency bands, and a non-feeding radiation electrode electromagnetically coupled to the feeding radiation electrode and performing an antenna operation in a plurality of resonant frequency bands, the antenna structure being capable of performing radio communication in at least four resonant frequency bands, the lowest fundamental resonant frequency band and a higher-order resonant frequency band higher than the lowest fundamental resonant frequency band among the plurality of resonant frequency bands of the feeding radiation electrode, and the lowest fundamental resonant frequency band and a higher-order resonant frequency band higher than the lowest fundamental resonant frequency band among the plurality of resonant frequency bands of the non-feeding radiation electrode. A main slit is formed in the feeding radiation electrode by cutting the feeding radiation electrode from an electrode edge of the feeding radiation electrode. One of the two sides of the main slit at the edge of the feeding radiation electrode that are separated by the main slit serves as the feeding end and the other of the two sides of the main slit serves as the open end. The feeding radiation electrode has a folded shape and includes a U-turn portion in the middle of a path circumventing the main slit from the feeding end toward the open end. A sub-slit for forming an open stub that is connected to the U-turn portion and that provides the U-turn portion with electrostatic capacitance is formed, independent of the main slit, in the feeding radiation electrode. In addition, a communication apparatus according to an aspect of the present invention includes the antenna structure having a feature according to the present invention.

According to the aspect of the present invention, the feeding radiation electrode is a folded-shaped radiation electrode including a U-turn portion, and an open stub that provides the U-turn portion with electrostatic capacitance is provided in the U-turn portion of the folded-shaped feeding radiation electrode. Due to the formation of the open stub, an LC resonant circuit (tank circuit) formed by electrostatic capacitance (C) based on the open stub and an inductance component of the U-turn portion of the feeding radiation electrode is locally provided in the U-turn portion of the feeding radiation electrode.

The LC resonant circuit is involved in, or affects a resonant frequency of the feeding radiation electrode. Due to the difference between current distribution of a fundamental resonant frequency and current distribution of a higher-order resonant frequency in the feeding radiation electrode, the degree of involvement, or effect of the LC resonant circuit in the higher-order resonant frequency of the feeding radiation electrode is dramatically larger than the degree of involvement, or effect of the LC resonant circuit in the fundamental resonant frequency of the feeding radiation electrode. Thus, by changing a value of electrostatic capacitance of the open stub (a value of electrostatic capacitance to be provided from the open stub to the U-turn portion), the higher-order resonant frequency of the feeding radiation electrode can be changed while hardly changing the fundamental resonant frequency of the feeding radiation electrode.

In addition, instead of changing the higher-order resonant frequency by changing the shape of the electrode on the current channel between the feeding end and the open end of the feeding radiation electrode as in the prior art, the higher-order resonant frequency is changed by changing a value of electrostatic capacitance of the open stub. Thus, variable control of the higher-order resonant frequency of the feeding radiation electrode can be achieved while considerably avoiding fluctuations in a resonant state or condition in a resonant frequency band other than the higher-order resonant frequency band of the feeding radiation electrode (for example, a resonant frequency, the phase of a resonance, and a Q-value), an impedance matching state, an electromagnetic coupling state between the feeding radiation electrode and the non-feeding radiation electrode, and the like.

In addition, the open stub is provided by forming the sub-slit in the feeding radiation electrode. Thus, complication in the shape of the feeding radiation electrode can be avoided. In addition, the length (electrical length) of the open stub is changed by changing the slit length and the cut position of the sub-slit. Thus, a value of electrostatic capacitance of the open stub can be easily changed, and variable control of the higher-order resonant frequency of the feeding radiation electrode can be achieved.

Since miniaturization of the antenna structure is desired, when the feeding radiation electrode is miniaturized in response to the desire, the electrical length of the feeding radiation electrode is reduced. Thus, it is difficult to lower the fundamental resonant frequency and the higher-order resonant frequency of the feeding radiation electrode. In contrast, with the present invention, since the main slit is formed in the feeding radiation electrode, due to electrostatic capacitance generated in the portion where the main slit is formed, the fundamental resonant frequency and the higher-order resonant frequency of the feeding radiation electrode can be lowered easily. Moreover, since the main slit is bent and includes a U-shaped portion, the slit length of the main slit is longer than that of a main slit having a linear shape. Thus, a value of the electrostatic capacitance of the main slit can be increased, and an inductance component of the feeding radiation electrode can be increased. Accordingly, the fundamental resonant frequency and the higher-order resonant frequency of the feeding radiation electrode can be much lowered while miniaturizing the feeding radiation electrode.

In addition, the feeding radiation electrode may be bent in accordance with a virtual extension line of the sub-slit serving as a bending line. Thus, advantages described below can be achieved. For example, when the feeding radiation electrode is disposed on the circuit substrate such that an electrode face of the feeding radiation electrode is substantially parallel to the substrate face of the circuit substrate, by bending the open stub of the feeding radiation electrode toward the circuit substrate in accordance with the bending line, which is the virtual extension line of the sub-slit, to dispose the open stub, for example, in a direction perpendicular to the circuit substrate, the area of the circuit substrate occupied by the antenna structure can be reduced. In other words, miniaturization in the antenna structure can be achieved.

In addition, since the feeding radiation electrode and the non-feeding radiation electrode are mounted on a dielectric substrate, the electrical length of each of the feeding radiation electrode and the non-feeding radiation electrode can be increased due to an advantage in shortening of a wavelength by the dielectric substrate. Thus, compared with a case where the feeding radiation electrode and the non-feeding radiation electrode are not mounted on the dielectric substrate, the physical length of the feeding radiation electrode and the non-feeding radiation electrode to achieve a desired resonant frequency can be reduced. Thus, miniaturization of the antenna structure can be advanced.

An edge of the open end of the feeding radiation electrode and an edge of the non-feeding radiation electrode that is adjacent to the edge of the feeding end of the feeding radiation electrode with a gap therebetween both serve as short-circuited portions for grounding. According to another aspect of the invention, the distance between outline sides, which face each other, of the feeding radiation electrode and the non-feeding radiation electrode that are adjacent to each other may be increased in a direction from an end of the short-circuited portion of each of the outline sides to an end opposite to the end of the short-circuited portion. Thus, an advantage is achieved in which the electromagnetic coupling state or condition between the feeding radiation electrode and the non-feeding radiation electrode can be easily controlled. In other words, it is desirable that the feeding radiation electrode and the non-feeding radiation electrode be capable of producing an excellent complex resonance in the electromagnetic coupling state. In contrast, when the distance between the feeding radiation electrode and the non-feeding radiation electrode is reduced in order to miniaturize the antenna structure, mutual interference between the feeding radiation electrode and the non-feeding radiation electrode caused by too strong electromagnetic coupling between the feeding radiation electrode and the non-feeding radiation electrode may prevent an excellent complex resonance. Thus, the distance between portions with a strong electric field (that is, portions away from the short-circuited portions) of the feeding radiation electrode and the non-feeding radiation electrode may be increased. Thus, since the too strong electromagnetic coupling between the feeding radiation electrode and the non-feeding radiation electrode can be moderated, an electromagnetic coupling state between the feeding radiation electrode and the non-feeding radiation electrode achieving an excellent complex resonance can be easily realized without increasing the size of the antenna structure.

The feeding radiation electrode and the non-feeding radiation electrode may be provided at a shorter side of a rectangular substrate (for example, a circuit substrate) such that the short-circuited portion is connected to the shorter side of the substrate. Thus, radio waves attracted from the feeding radiation electrode and the non-feeding radiation electrode to the circuit substrate can be suppressed, and radio waves can be easily emitted from the antenna structure to the outside. Therefore, the antenna gain of the antenna structure can be improved.

At least one of the feeding radiation electrode and the non-feeding radiation electrode may be one of a plurality of radiation electrodes. Thus, the number of resonant frequency bands in which the antenna structure is capable of performing radio communication is easily increased.

A communication apparatus including the antenna structure having a feature according to the present invention is capable of performing radio communication in a plurality of resonant frequency bands with an excellent sensitivity without increasing the size of the communication apparatus.

Other features and advantages of the present invention will become apparent from the following description of embodiments of invention which refers to the accompanying drawings.

DETAILED DESCRIPTION OF EMBODIMENTS OF THE INVENTION

Embodiments of the present invention will be described with reference to the drawings.

Figure 1A:
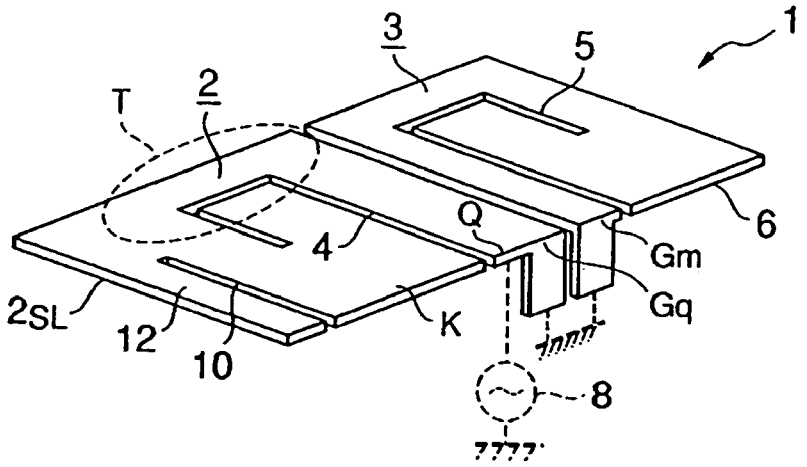
FIG. 1*a* is an illustration for explaining an antenna structure according to a first embodiment.
Figure 11A:
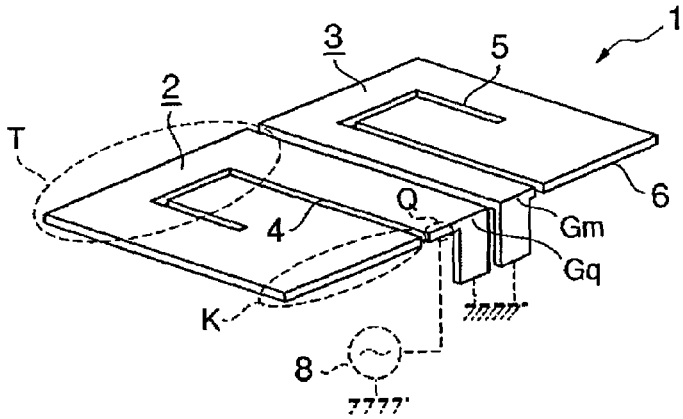
FIG. 11a PRIOR ART
FIG. 11*a* is an illustration for explaining an example of a prior antenna structure.
Figure 11B:
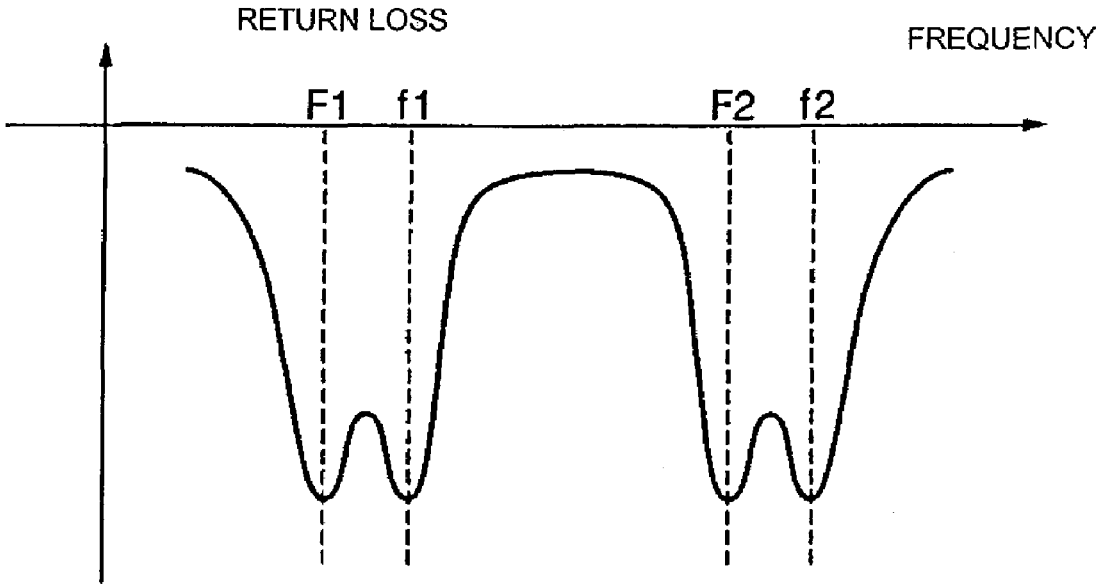
FIG. 11b PRIOR ART
FIG. 11*b* is a graph showing an example of the return loss characteristics of the antenna structure shown in FIG. 11*a*.
Figure 12:
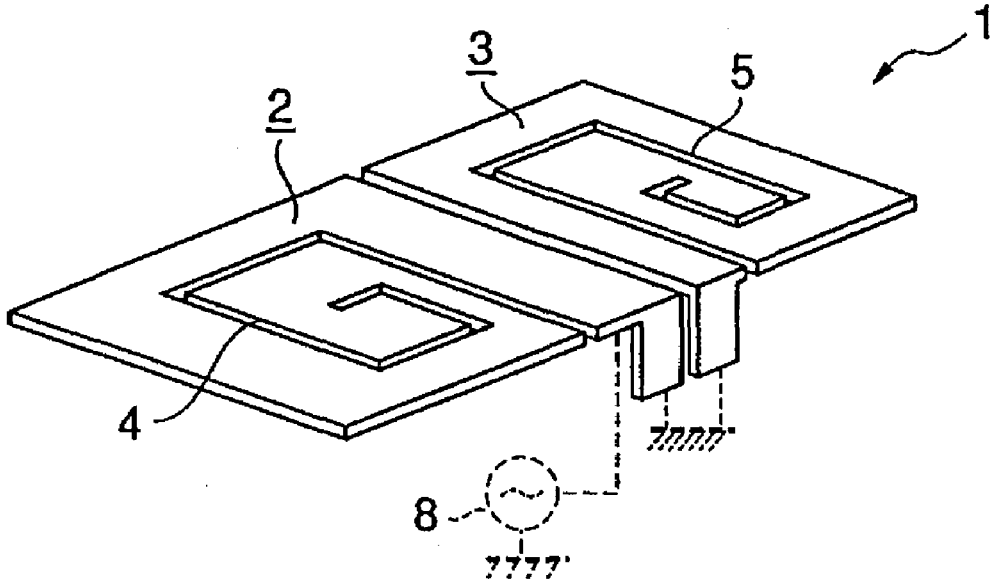
FIG. 12 PRIOR ART
FIG. 12 is a model diagram showing a structural example when a main slit having a spiral shape (coiled shape) is formed in a feeding radiation electrode.

FIG. 1*a* is a perspective view schematically showing an antenna structure according to a first embodiment. In the explanation of the first embodiment, the same parts as in the antenna structure shown in FIG. 11 a are referred to with the same reference numerals and the descriptions of those same parts will not be repeated here.

The antenna structure 1 according to the first embodiment includes the feeding radiation electrode 2 and the non-feeding radiation electrode 3. For example, as shown by the return loss characteristics represented by the solid line in FIG. 1*c*, the antenna structure 1 is capable of performing radio communication in four resonant frequency bands, that is, a fundamental resonant frequency band on a feeding side based on the fundamental resonant frequency F1 and a higher-order resonant frequency band on the feeding side based on the higher-order resonant frequency F2 of the feeding radiation electrode 2 and a fundamental resonant frequency band on a non-feeding side based on the fundamental resonant frequency f1 and a higher-order resonant frequency band on the non-feeding side based on the higher-order resonant frequency f2 of the non-feeding radiation electrode 3.

Figure 1B:
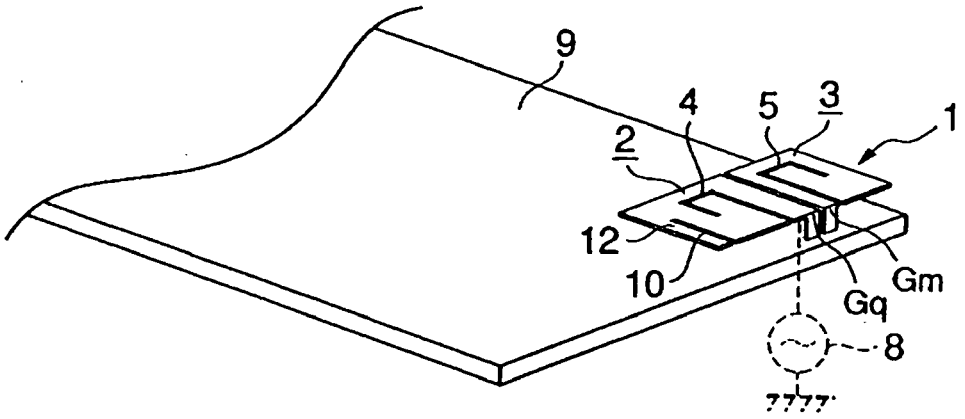
FIG. 1*b* is an illustration for explaining an example of the arrangement of a feeding radiation electrode and a non-feeding radiation electrode shown in FIG. 1*a* on a substrate.

In addition, as shown in FIG. 1*b*, the feeding radiation electrode 2 and the non-feeding radiation electrode 3 are provided, for example, at an end on a shorter side of a circuit substrate (rectangular substrate) 9 of a radio communication apparatus such that the short-circuited portions Gq and Gm are disposed adjacent to each other and such that the short-circuited portions Gq and Gm are connected to the shorter side of the substrate.

In the first embodiment, the substantially U-shaped main slit 4 is formed in the feeding radiation electrode 2. Thus, the feeding radiation electrode 2 is a folded-shaped radiation electrode including the U-turn portion T. In addition to the main slit 4, a sub-slit 10 is formed in the feeding radiation electrode 2.

One side portion and the other side portion of the main slit 4 separated by the main slit 4 have the feeding end Q and the open end K respectively. The sub-slit 10 is formed by cutting the feeding radiation electrode 2 from an electrode edge of the open end K. And the sub-slit 10 extends along an outline side $\mathbf{2}_{SL}$ of the feeding radiation electrode 2 in a direction toward the U-turn portion T of the feeding radiation electrode 2. Due to the sub-slit 10, an open stub 12 that provides the U-turn portion T with electrostatic capacitance is formed.

Due to the formation of the open stub 12, an equivalent LC resonant circuit (tank circuit) is locally formed in the U-turn portion T of the feeding radiation electrode 2 by electrostatic capacitance (C) of the open stub 12 and an inductance component (L) of the U-turn portion T.

Figure 2:
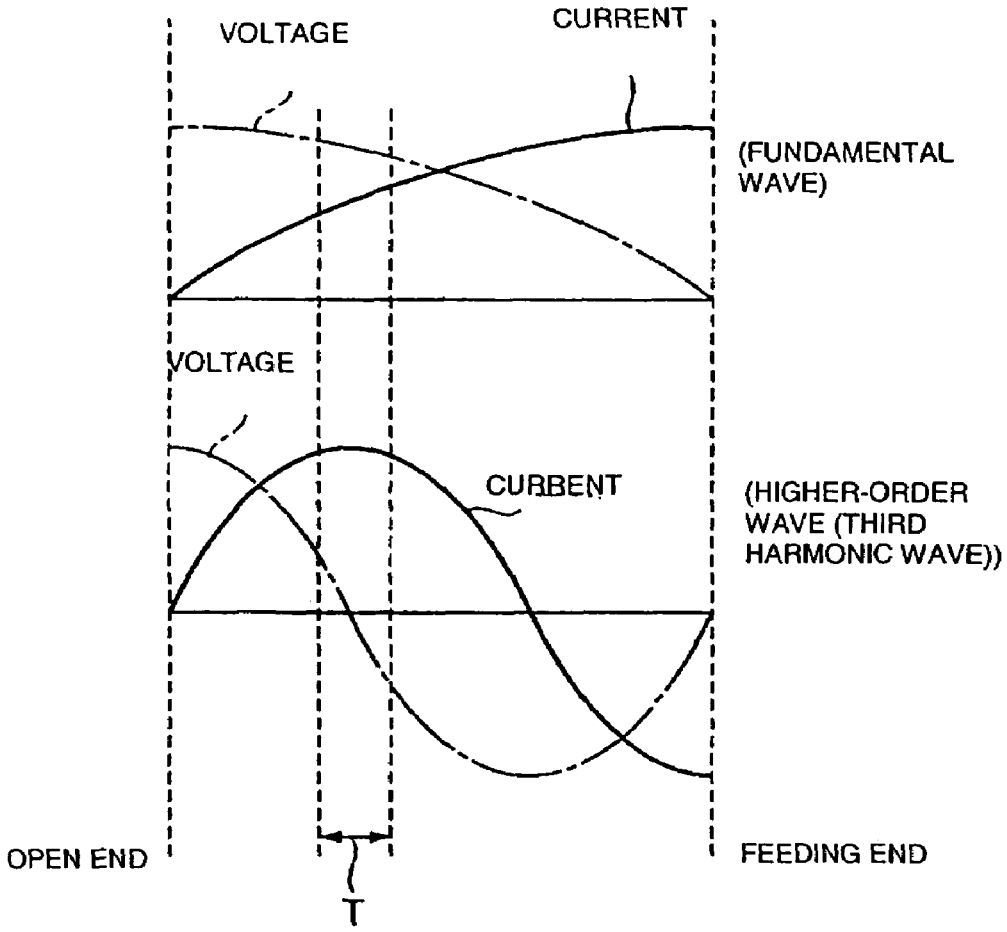
FIG. 2 is an illustration for explaining an example of current distribution and voltage distribution of a radiation electrode.

FIG. 2 illustrates examples of current distribution and voltage distribution of the fundamental resonant frequency F1 (fundamental wave) and current distribution and voltage distribution of the higher-order resonant frequency F2 (higher-order wave (third harmonic wave)) in the feeding radiation electrode 2. As is clear from FIG. 2, the U-turn portion T of the feeding radiation electrode 2 defines a higher-order-wave maximum current distribution region and does not define a fundamental-wave maximum current distribution region. Thus, the LC resonant circuit formed by the open stub 12 is greatly involved in the higher-order resonant frequency F2 and has a small influence on the fundamental resonant frequency F1. Thus, by changing the electrostatic capacitance to be provided from the open stub 12 to the U-turn portion T, variable control of the higher-order resonant frequency F2 can be achieved while hardly changing the fundamental resonant frequency F1 of the feeding radiation electrode 2.

Figure 1C:
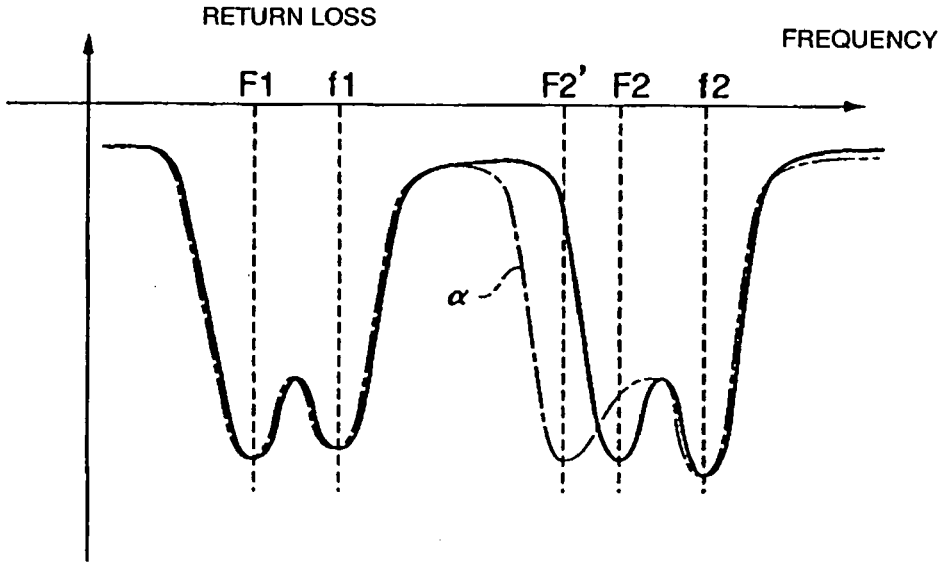
FIG. 1*c* is a graph showing an example of the return loss characteristics of the antenna structure according to the first embodiment.

For example, when the electrostatic capacitance of the open stub 12 is increased by increasing the slit length of the sub-slit 10, the higher-order resonant frequency F2 on the feeding side can be lowered to a higher-order resonant frequency F2', as shown by the wave line cc in FIG. 1*c*. Moreover, fluctuations in a resonant state of other resonant frequency bands due to variable control of the higher-order resonant frequency F2 (for example, a resonant frequency, a Q-value, and the phase of a resonance), in an impedance matching state, an electromagnetic coupling state between the feeding radiation electrode 2 and the non-feeding radiation electrode 3, can be suppressed.

Figure 3:
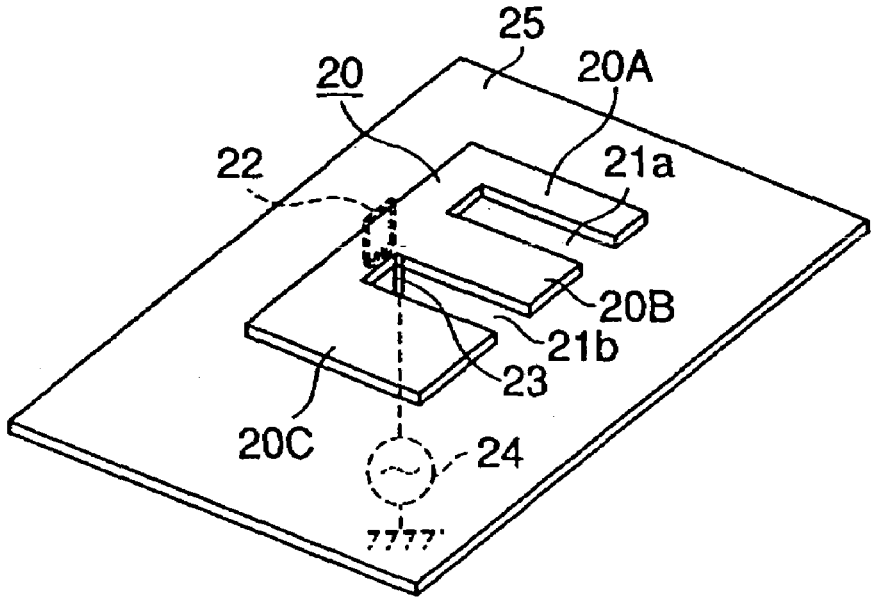
FIG. 3 is a model diagram showing an antenna structure described in Patent Document 1.

An example shown by a model diagram of FIG. 3 in which two slits 21*a* and 21*b* are formed in a radiation electrode 20 is described in Patent Document 1. In FIG. 3, reference numeral 22 denotes a grounding conductor plate for connecting the radiation electrode 20 to the ground, reference numeral 23 denotes a feeding pin for connecting the radiation electrode 20 to a high-frequency circuit 24, and reference numeral 25 denotes a grounding plate.

In Patent Document 1, the radiation electrode 20 is divided into a plurality of sections by forming the slits 21*a* and 21*b* in the radiation electrode 20, so that the radiation electrode 20 performs a plurality of resonances. In other words, the structure described in Patent Document 1 is equivalent to a state in which a plurality of radiation electrode parts 20A, 20B, and 20C is connected to the common feeding pin 23 (and to the high-frequency circuit 24). That is, the slits 21*a* and 21*b* are provided for forming the plurality of radiation electrode parts 20A, 20B, and 20C and for causing the radiation electrode 20 to perform a plurality of resonances.

In contrast, in the structure of the first embodiment, the main slit 4 of the feeding radiation electrode 2 is provided for controlling the fundamental resonant frequency F1 and the higher-order resonant frequency F2 of the feeding radiation electrode 2, and the sub-slit 10 is provided for forming the open stub 12 that provides the U-turn portion T of the feeding radiation electrode 2 with electrostatic capacitance. As described above, the main slit 4 and the sub-slit 10 shown in the first embodiment have functions different from the slits 21*a* and 21*b* of the radiation electrode 20 described in Patent Document 1. The structure of the first embodiment in which the main slit 4 for controlling resonant frequencies and the sub-slit 10 for forming an open stub are formed in the feeding radiation electrode 2 is innovative.

In the example shown in FIG. 1*a*, the sub-slit 10 has a linear shape. However, the shape of the sub-slit 10 is not particularly limited as long as the sub-slit 10 is capable of forming the open stub 12 that provides the U-turn portion T of the feeding radiation electrode 2 with electrostatic capacitance. For example, in order to increase the slit length of the sub-slit 10 to lower the higher-order resonant frequency F2 of the feeding radiation electrode 2, the sub-slit 10 may be formed along the outline side $\mathbf{2}_{SL}$ of the feeding radiation electrode 2 by cutting the feeding radiation electrode 2 from an electrode edge of the open end K and then cutting toward the U-turn portion T, as shown in FIG. 4*a*.

Figure 4A:
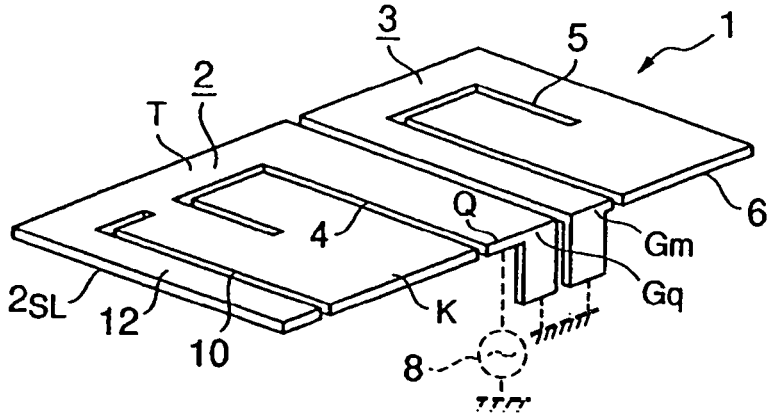
FIG. 4*a* is an illustration for explaining another example of a sub-slit formed in the feeding radiation electrode.
Figure 4B:
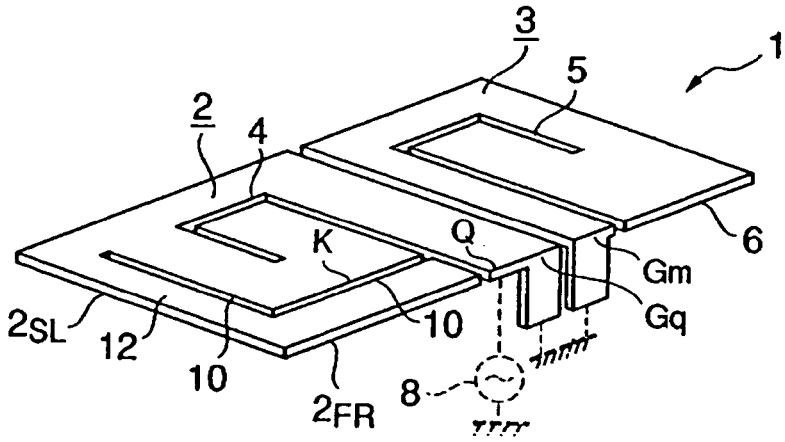
FIG. 4*b* is an illustration for explaining another example of the sub-slit formed in the feeding radiation electrode.

In addition, in order to increase the slit length of the sub-slit 10 to be longer than the slit length in the example shown in FIG. 1*a* or FIG. 4*a*, for example, the sub-slit 10 may have a shape shown in FIG. 4*b*. The sub-slit 10 shown in FIG. 4*b* has an L shape and is formed by branching from the main slit 4 on the electrode cut side of the main slit 4 and extending along outline sides $\mathbf{2}_{FR}$ and $\mathbf{2}_{SL}$ of the feeding radiation electrode 2.

A second embodiment is described next. In the explanation of the second embodiment, the same parts as in the first embodiment are referred to with the same reference numerals and the descriptions of those same parts will not be repeated here.

Figure 5:
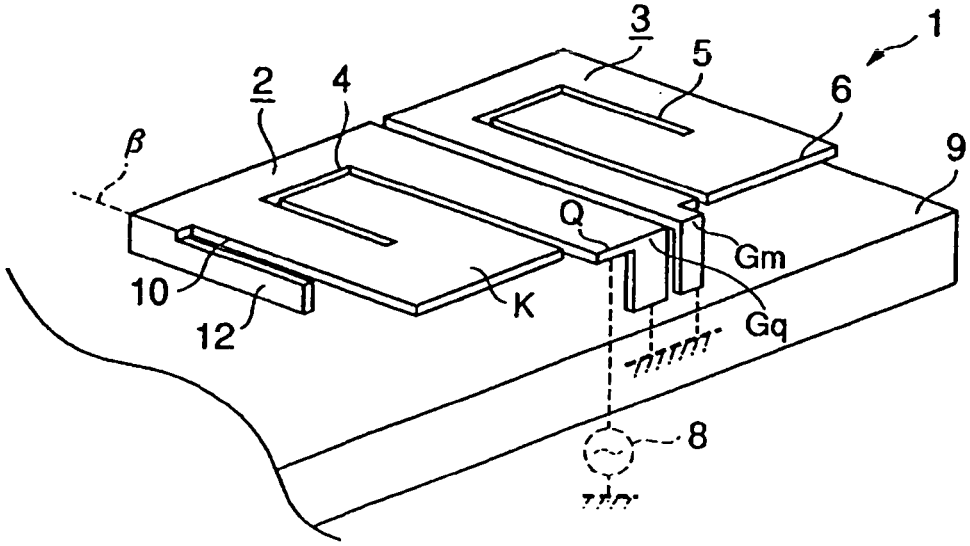
FIG. 5 is a model diagram for explaining an antenna structure according to a second embodiment.

In the second embodiment, as shown by a model diagram of FIG. 5, the feeding radiation electrode 2 has a shape in which the open stub 12 is bent toward the circuit substrate 9 in accordance with a virtual extension line β of the sub-slit 10 shown by a dotted line in FIG. 5.

In the second embodiment, since the open stub 12 is a portion that is not involved in radio wave radiation, the open stub 12 can be bent without considering deterioration of a radio wave radiation state. Due to bending of the open stub 12, the area of the circuit substrate 9 occupied by the antenna structure 1 (the feeding radiation electrode 2) can be reduced (that is, the antenna structure 1 can be miniaturized). The other structural features are similar to those in the first embodiment, and advantages similar to those of the first embodiment can be achieved.

A third embodiment is described next. In the explanation of the third embodiment, the same parts as in the first and second embodiments are referred to with the same reference numerals and the descriptions of those same parts will not be repeated here.

Figure 6:
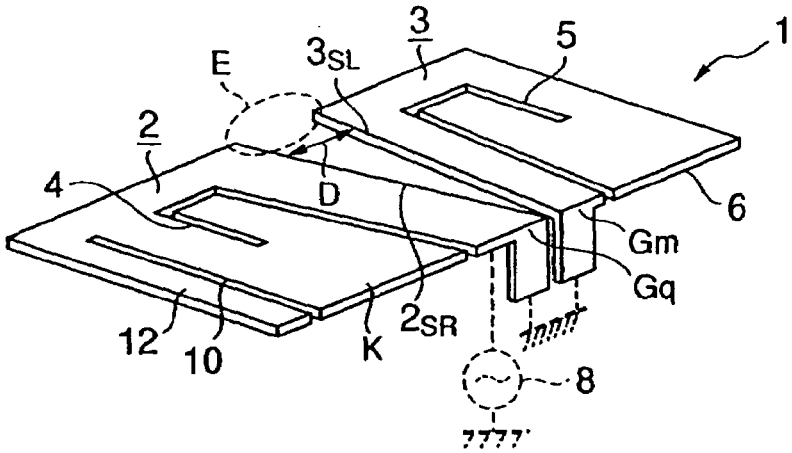
FIG. 6 is a model diagram for explaining an antenna structure according to a third embodiment.

In the third embodiment, as shown in FIG. 6, the distance D between outline sides $\mathbf{2}_{SR}$ and $\mathbf{3}_{SL}$, which face each other, of the feeding radiation electrode 2 and the non-feeding radiation electrode 3 that are adjacent to each other increases in a direction from the short-circuited portions Gq and Gm of the outline sides $\mathbf{2}_{SR}$ and $\mathbf{3}_{SL}$ toward an end E opposite to the short-circuited portions Gq and Gm.

The other structural features are similar to those in the first and second embodiments. In the example shown in FIG. 6, an example when the structure of the third embodiment is applied to the structure shown in the first embodiment is illustrated. However, the structure of the third embodiment may also be applied, for example, to the antenna structure 1 shown in the second embodiment in which the open stub 12 is bent.

Advantages similar to those in the first and second embodiments can be achieved in the third embodiment. In addition, the third embodiment achieves an advantage in that an electromagnetic coupling state between the feeding radiation electrode 2 and the non-feeding radiation electrode 3 can be controlled easily and in that an excellent complex resonance of the feeding radiation electrode 2 and the non-feeding radiation electrode 3 can be easily achieved.

A fourth embodiment is described next. In the explanation of the fourth embodiment, the same parts as in the first to third embodiments are referred to with the same reference numerals and the descriptions of those same parts will not be repeated here.

Figure 7A:
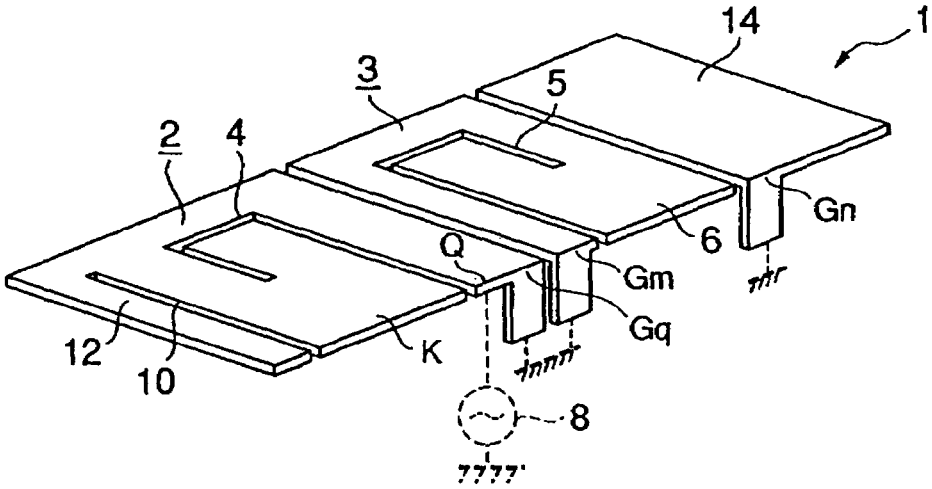
FIG. 7*a* is an illustration for explaining an antenna structure according to a fourth embodiment.

In the fourth embodiment, as shown in FIG. 7*a*, in addition to the feeding radiation electrode 2 and the non-feeding radiation electrode 3, a non-feeding radiation electrode 14 is provided. The non-feeding radiation electrode 14 is electromagnetically coupled to the feeding radiation electrode 2 via the non-feeding radiation electrode 3. The non-feeding radiation electrode 14 includes a short-circuited portion Gn for grounding. The feeding radiation electrode 2, the non-feeding radiation electrode 3, and the non-feeding radiation electrode 14 are aligned in a line such that the short-circuited portions Gq, Gm, and Gn are aligned with respect to each other.

Figure 7B:
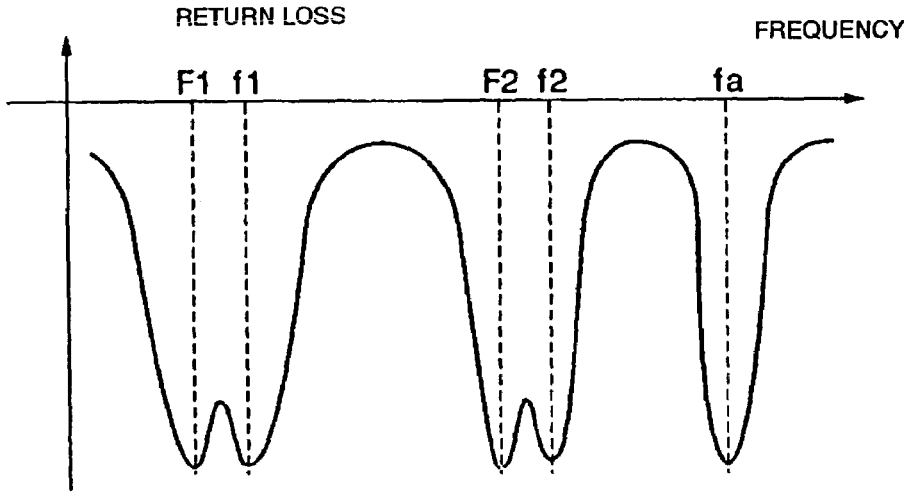
FIG. 7*b* is a graph showing an example of the return loss characteristics of the antenna structure according to the fourth embodiment.

As shown by the return loss characteristics in FIG. 7*b*, the antenna structure 1 according to the fourth embodiment is capable of including, in addition to four resonant frequency bands based on the feeding radiation electrode 2 and the non-feeding radiation electrode 3, another resonant frequency band based on a resonant frequency fa of the non-feeding radiation electrode 14.

Structural features of the fourth embodiment other than the structural feature relating to the non-feeding radiation electrode 14 are similar to those in the first to third embodiments. In the example shown in FIG. 7*a*, the feeding radiation electrode 2 and the non-feeding radiation electrode 3 have structures as in the first embodiment. However, the feeding radiation electrode 2 and the non-feeding radiation electrode 3 may have the structure as in the second or third embodiment, for example.

A fifth embodiment is described next. In the fifth embodiment, the same parts as in the first to fourth embodiments are referred to with the same reference numerals and the descriptions of those same parts will not be repeated here.

Figure 8A:
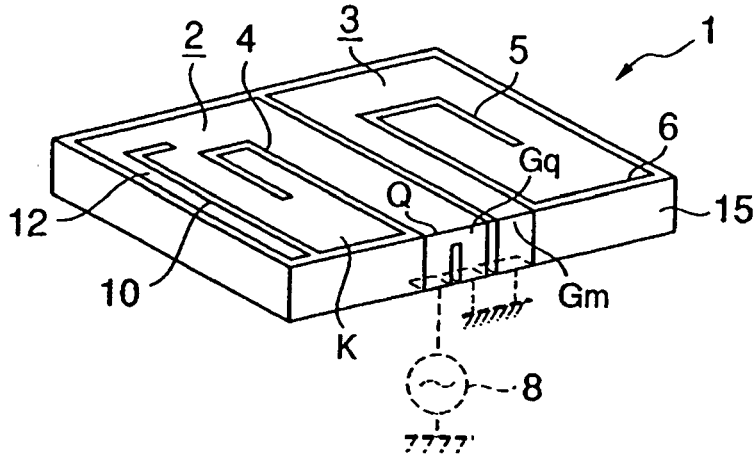
FIG. 8*a* is a model diagram for explaining an example of the antenna structure having a feature according to a fifth embodiment.
Figure 8B:
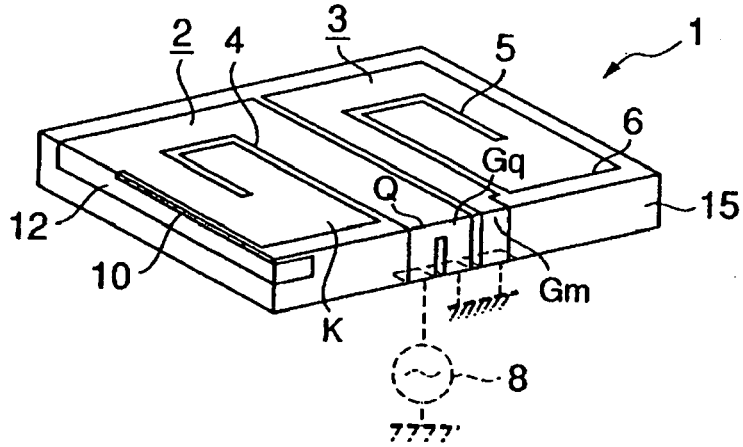
FIG. 8*b* is a model diagram for explaining another example of the antenna structure having a feature according to the fifth embodiment.
Figure 8C:
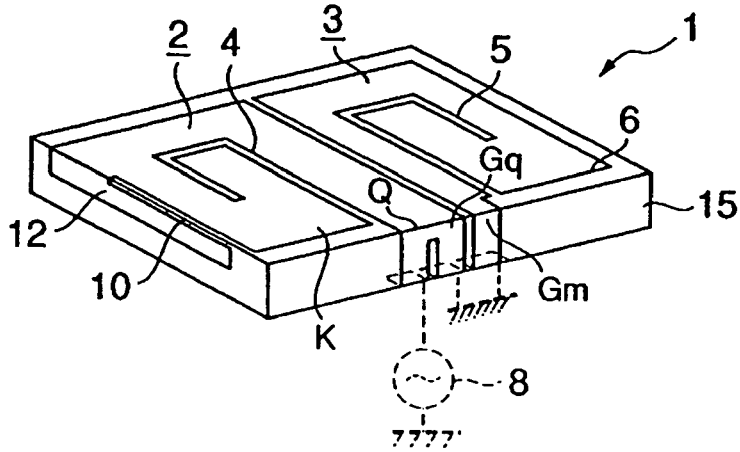
FIG. 8*c* is a model diagram for explaining another example of the antenna structure having a feature according to the fifth embodiment.

In the fifth embodiment, as shown in FIGS. 8*a*, 8*b*, and 8*c*, the feeding radiation electrode 2 and the non-feeding radiation electrode 3 described in the first, second, or third embodiment and optionally the non-feeding radiation electrode 14 described in the fourth embodiment are mounted on a dielectric substrate 15 made of, for example, dielectric ceramics or a compound dielectric material. The other structural features are similar to those in the first to fourth embodiments.

In the fifth embodiment, since the feeding radiation electrode 2 and the non-feeding radiation electrodes 3 and optionally 14 are mounted on the dielectric substrate 15, due to an advantage in shortening of a wavelength by dielectric medium, the electrical length of each of the feeding radiation electrode 2, the non-feeding radiation electrode 3, and the non-feeding radiation electrode 14 can be increased. Thus, the radiation electrodes 2, 3, and 14 can be miniaturized. In other words, miniaturization of the antenna structure 1 can be easily achieved.

A sixth embodiment is described next. The sixth embodiment relates to a communication apparatus. The communication apparatus according to the sixth embodiment includes the antenna structure 1 described in the first, second, third, fourth, or fifth embodiment. Since the antenna structure 1 has been described above, the description of the antenna structure 1 will be omitted. In addition, apart from the antenna structure 1, various structures may be adopted for the communication apparatus. Any structure can be adopted, such as the high frequency circuit 8, and the description of the structure of the communication apparatus is omitted here.

The present invention is not limited to each of the first to sixth embodiments, and various modifications can be made to the present invention. For example, in the fifth embodiment, the feeding radiation electrode 2 and the non-feeding radiation electrodes 3 and 14 are formed by conductor plates, as in each of the first to fourth embodiments. However, the feeding radiation electrode 2 and the non-feeding radiation electrodes 3 and 14 may be formed by conductor films produced on an outer surface of the dielectric substrate 15 by a film deposition technology, such as sputtering, vapor deposition, or printing.

Figure 9:
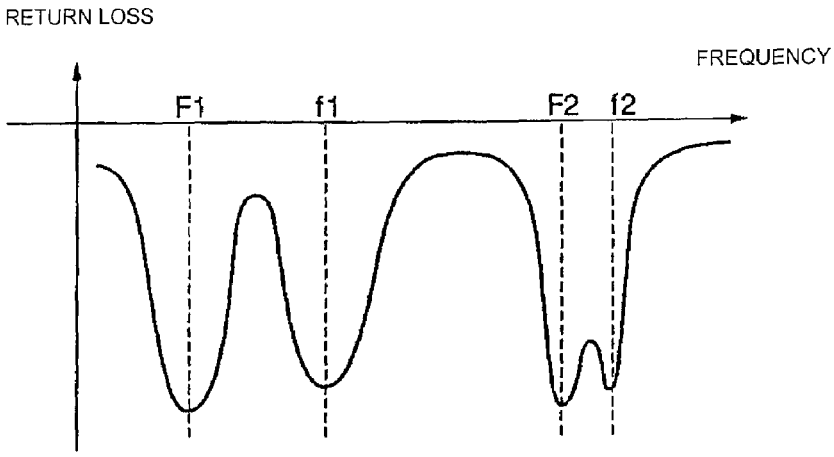
FIG. 9 is an illustration for explaining another embodiment.

In addition, for the return loss characteristics shown in FIG. 1*c* or FIG. 7*b*, an example in which a fundamental resonant frequency band of the feeding radiation electrode 2 and a fundamental resonance frequency band of the non-feeding radiation electrode 3 produce a complex resonance and the width of the fundamental resonant frequency bands is increased is described. However, for example, when each of the fundamental resonant frequency bands of the feeding radiation electrode 2 and the non-feeding radiation electrode 3 has a bandwidth in which radio communication can be performed satisfactorily only in the individual fundamental resonant frequency band, the fundamental resonance frequency band of the feeding radiation electrode 2 and the fundamental resonant frequency band of the non-feeding radiation electrode 3 may be independent of each other, for example, as shown by the return loss characteristics in FIG. 9, instead of producing a complex resonance by the fundamental resonant frequency band of the feeding radiation electrode 2 and the fundamental resonant frequency band of the non-feeding radiation electrode 3.

In addition, in the fourth embodiment, the non-feeding radiation electrode 14 is provided, in addition to the feeding radiation electrode 2 and the non-feeding radiation electrode 3. However, in addition to the feeding radiation electrode 2 and the non-feeding radiation electrode 3, two or more non-feeding radiation electrodes may be provided. Alternatively, in addition to the feeding radiation electrode 2 and the non-feeding radiation electrode 3, one or more feeding radiation electrodes may be provided, instead of providing another non-feeding radiation electrode. Alternatively, a plurality of feeding radiation electrodes and a plurality of non-feeding radiation electrodes including the feeding radiation electrode 2 and the non-feeding radiation electrode 3 described in any of the first to fifth embodiments may be provided. When three or more radiation electrodes are provided as described above, such radiation electrodes are aligned in a line such that short-circuited portions are aligned on the same side.

In addition, the open stub 12 is provided by forming the sub-slit 10 in the feeding radiation electrode 2 in each of the first to sixth embodiments. However, for example, as shown by a model diagram in FIG. 10, in addition to the feeding radiation electrode 2, the non-feeding radiation electrode 3 is provided with an open stub 16 that provides the U-turn portion of the non-feeding radiation electrode 3 with electrostatic capacitance by forming a sub-slit 17, which is similar to the sub-slit 10 of the feeding radiation electrode 2 described in each of the first to fifth embodiments, for forming the open stub.

Figure 10:
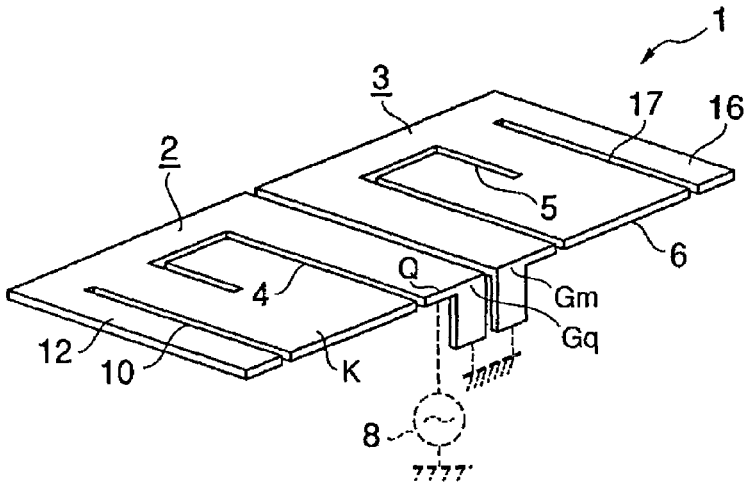
FIG. 10 is a model diagram showing an example when a sub-slit for forming an open stub is formed in a non-feeding radiation electrode.

In this case, variable control of the higher-order resonant frequency f2 of the non-feeding radiation electrode 3, as well as the higher-order resonant frequency F2 of the feeding radiation electrode 2, can be performed easily. Although a structural example in which the sub-slit 17 for forming an open stub is formed in the non-feeding radiation electrode 3 of the antenna structure 1 described in the first embodiment is shown in FIG. 10, in addition, the sub-slit 17 for forming an open stub may be formed in the non-feeding radiation electrode 3 of the antenna structure 1 according to each of the second to fifth embodiments. In addition, the non-feeding radiation electrode 3 may include the open stub 16 that is bent in accordance with a virtual extension line of the sub-slit 17 serving as a bending line.

Since a structure easily achieving excellent radio communication in a plurality of required frequency bands is provided, the present invention is effective for, for example, an antenna structure and a communication apparatus used for a plurality of radio communication systems in common.

Although the present invention has been described in relation to particular embodiments thereof, many other variations and modifications and other uses will become apparent to those skilled in the art. Therefore, the present invention is not limited by the specific disclosure herein.

What is claimed is:

1. An antenna structure that comprises a feeding radiation electrode including one end serving as a feeding end and the other end serving as an open end and performing an antenna operation in a plurality of resonant frequency bands and a non-feeding radiation electrode electromagnetically coupled to the feeding radiation electrode and performing an antenna operation in a plurality of resonant frequency bands and said antenna structure being capable of performing radio communication in at least four resonant frequency bands, the lowest fundamental resonant frequency band and a higher-order resonant frequency band higher than the lowest fundamental resonant frequency band among the plurality of resonant frequency bands of the feeding radiation electrode, and the lowest fundamental resonant frequency band and a higher-order resonant frequency band higher than the lowest fundamental resonant frequency band among the plurality of resonant frequency bands of the non-feeding radiation electrode, wherein a main slit is formed in the feeding radiation electrode by a cut in the feeding radiation electrode from an electrode edge of the feeding radiation electrode, wherein one of two sides of the main slit located at an edge of the feeding radiation electrode that are separated by the main slit serves as the feeding end and the other side of the two sides of the main slit located at the edge of the feeding radiation electrode that are separated by the main slit serves as the open end, wherein the feeding radiation electrode has a folded shape and includes a U-turn portion in the middle of a path circumventing the main slit from the feeding end toward the open end, and wherein a sub-slit for forming an open stub that is connected to the U-turn portion and that provides the U-turn portion with electrostatic capacitance is formed, independent of the main slit, in the feeding radiation electrode.

2. The antenna structure according to claim 1, wherein the main slit has a bent shape including a U-shaped portion.

3. The antenna structure according to claim 1, wherein the feeding radiation electrode is bent in accordance with a virtual extension line of the sub-slit serving as a bending line.

4. The antenna structure according to claim 1, wherein the feeding radiation electrode and the non-feeding radiation electrode are mounted on a dielectric substrate.

5. The antenna structure according to claim 1, wherein an edge of the feeding end of the feeding radiation electrode, and an edge of the non-feeding radiation electrode that is adjacent to the edge of the feeding end of the feeding radiation electrode with a gap therebetween, serve as short-circuited portions for grounding, and wherein the distance between outline sides, which face each other, of the feeding radiation electrode and the non-feeding radiation electrode that are adjacent to each other increases in a direction from an end of the outline sides at the short-circuited portion toward an end of the outline sides opposite to the end at the short-circuited portion.

6. The antenna structure according to claim 5, wherein at least one of the feeding radiation electrode and the non-feeding radiation electrode is one of a plurality of radiation electrodes, and wherein the feeding radiation electrode and the non-feeding radiation electrode are aligned in a line such that the short-circuit portions are aligned on the same side.

7. The antenna structure according to claim 1, wherein an edge of the feeding end of the feeding radiation electrode, and an edge of the non-feeding radiation electrode that is adjacent to the edge of the feeding end of the feeding radiation electrode with a gap therebetween, serve as short-circuited portions for grounding, and wherein each of the feeding radiation electrode and the non-feeding radiation electrode is provided at a shorter side of a rectangular substrate such that the short-circuited portion is connected to the shorter side of the substrate.

8. The antenna structure according to claim 7, wherein at least one of the feeding radiation electrode and the non-feeding radiation electrode is one of a plurality of radiation electrodes, and wherein the feeding radiation electrode and the non-feeding radiation electrode are aligned in a line such that the short-circuit portions are aligned on the same side.

9. A communication apparatus comprising the antenna structure as set forth in claim 1, and a high-frequency circuit connected thereto.

* * * * *